United States Patent [19]

Montgomery et al.

[11] 4,054,750

[45] Oct. 18, 1977

[54] FULL RANGE ROTATABLE SPEAKER HOUSING WITH OPPOSITELY DIRECTED SPEAKERS

[76] Inventors: Ralph Montgomery; Richard E. Bowe, both of 11475 Kittridge St., North Hollywood, Calif. 91606

[21] Appl. No.: 697,376

[22] Filed: June 18, 1976

[51] Int. Cl.[2] ..... H04R 1/02; H04R 1/20

[52] U.S. Cl. ..... 179/1 E; 181/147

[58] Field of Search ..... 179/1 E, 1 GA, 1 GP, 179/1 T; 181/143, 144, 147, 148, 175

[56] References Cited

U.S. PATENT DOCUMENTS

| | | | |
|---|---|---|---|
| 1,866,831 | 7/1932 | Wolff et al. | 181/147 |
| 3,491,204 | 1/1970 | Sherno | 179/1 GA |
| 3,903,989 | 5/1974 | Bauer | 181/144 |

FOREIGN PATENT DOCUMENTS

| | | | |
|---|---|---|---|
| 939,511 | 2/1956 | Germany | 179/1 E |

OTHER PUBLICATIONS

*Audio* Aug. 1974, p. 61.
*Stereo Review* June, 1975.

*Primary Examiner*—George G. Stellar
*Attorney, Agent, or Firm*—Robert D. Farkas

[57] ABSTRACT

A plurality of speakers are carried on a generally vertical board. The board is carried for pivotal motion about a vertical axis. The board is housed within an enclosure permitting sound radiation in all directions. Some speakers are directed to face oppositely from other speakers, all of which having a different operating frequency. One of the speakers is driven by a separate amplifier. The system is truly omnidirectional with acoustical phase problems being overcome because all but the high frequency drivers or tweeters have the same size.

4 Claims, 2 Drawing Figures

FULL RANGE ROTATABLE SPEAKER HOUSING WITH OPPOSITELY DIRECTED SPEAKERS

BACKGROUND OF THE INVENTION

1. The Field of the Invention

This invention relates to speaker system apparatus and more particularly to devices possessing omnidirectional sound dispersion characteristics.

2. Description of the Prior Art

The prior art abounds with apparatus utilized to disperse sound in varying directions.

U.S. Pat. No. 3,491,204 issued on Jan. 20, 1970 to S.A. Sherno teaches a sound system circuit and cabinet assembly employing a multi-channel stereo reproducing system having a center output channel derived from the two stereo channels. The stereo channels each has a plurality of speakers, and the derived center channel likewise has a plurality of speakers. The stereo reproducing speakers are mounted in vertically-pivoted enclosures. The center channel reproducing speakers are mounted in a fixed enclosure located between the vertically-pivoted stereo reproducing enclosures. The side vertically-pivoted enclosures each utilize a rectangular enclosure having a base speaker mounted on one vertical base thereof. The adjacent face, similarly disposed in a vertical plane is at right angles to the face bearing the base speaker and provides support for a mid-range speaker and a high frequency range speaker. The sound dispersion from each pivotable side enclosure is thus directed in a discrete pattern pivotably varied as the enclosure is rotated. This fact, coupled with the stationary sound dispersion characteristics of the center speaker baffle, produces an overall pattern which, though variable, is not truly omnidirectional.

U.S. Pat. No. 3,903,989 issued on Sep. 9, 1975 to B.B. Bauer discloses a loudspeaker system having a cabinet with two compartments, a first of which contains a low frequency loudspeaker for producing an omnidirectional radiation pattern, and a second compartment above the first, containing a rotationally adjustable vertically oriented baffle on which are supported additional loudspeakers motors designed to cover the mid- and high-frequency bands of the audio-frequency spectrum. The baffle is so shaped and the additional loudspeaker motors located in positions thereon that they operate as high efficiency gradient or dipole loudspeakers over a significant portion of their respective frequency ranges, whereby the directivity of the loudspeaker system can be controlled by adjustment of the position of the baffle relative to the cabinet. Since the stationary speaker produces a fixed acoustically directed pattern for the higher frequency components of the audible spectrum, a mixed pattern, dependent upon the frequency involved, is achieved.

All the prior art suffer the common deficiency in not disclosing a speaker apparatus, having a plurality of speakers, operated in discrete frequency bands, that are truly omnidirectional and substantially represent a dipole source of sound for all frequencies in the audio spectrum. Though a perfect point source for a sound apparatus, capable of handling all frequencies, is not currently available, the present invention provides an omnidirectional speaker apparatus possessing minimally two major lobes, oppositely directed, wherein each lobe is identical to its mate and covers a wide dispersion angle. The rotational ability of the baffle arrangement permits the lobes to be oriented at any angle desired.

SUMMARY OF THE INVENTION

A primary object of the present invention is to provide a speaker apparatus which is omnidirectional.

Another object of the present invention is to provide a speaker baffle which may permit the more highly directed high frequency sound components to be angularly directed simultaneously with the less directional low frequency components of the audio frequency spectrum.

Still another object of the present invention is to provide an omnidirectional speaker apparatus which utilizes three frequency bands and two sizes of speakers, thereby minimizing phase distortion.

Yet another object of the present invention is to provide an omnidirectional speaker which may be positioned relative to the walls of a room thereby enhancing the esthetic appearance of the apparatus in conjunction with other furniture disposed within the room.

The prior art recognizes the need to selectively direct speaker apparatus used to produce the higher frequency components within the audible spectrum. The present invention also incorporates this concept but advances it by providing that sounds directed outwardly from a speaker enclosure, when in the high frequency end of the audio spectrum, is highly directional and therefore must be directed outwardly from the enclosure on opposed sides therefrom. By adding the capability of rotating such a bi-directional apparatus, a sound source is created which is virtually omnidirectional, and because of the improvement in the mutual directionability of all the frequency components of the sound spectrum therein, represents a substantial improvement of the state of the art.

These objects, as well as other objects of the present invention will become more readily apparent after reading the following description of the accompanying drawings.

DESCRIPTION OF THE PREFERRED EMBODIMENT

The structure and method of fabrication of the present invention is applicable to an enclosure adapted to be supported upon a horizontally disposed supporting surface, such as a floor. The enclosure includes four walls fabricated from a speaker grille material and four stud-like elements separating the base and cap elements of the assembly. Affixed to the base and cap elements are a pair of blocks having pivot rods, each co-axially aligned with the other and lying on a vertical line extending normal to the exterior surfaces of the base and cap elements. A baffle plate resides in a vertical plane and may be pivoted about the pivot rods, being separated therefrom by a fixed distance and inter-connected thereto by a pair of legs, affixed to each end of the baffle plate and lying in spaced apart horizontal planes. Holes, piercing legs, permit the entry of the pivot rods.

Affixed to the baffle plate are four equi-sized loudspeaker apparatus, disposed in spaced apart relationship from each other and lying on a vertical centrally located line. The uppermost pair of these four speakers are designed to be operated in the frequency range of 500 to 10,000 Hz and face radially outwardly from the pivot rods. The next lowest speaker, also operating in the mid-range of 500 to 10,000 Hz, is secured to the baffle so as to be directed radially inwardly towards the axis of the pivot rods. The lowermost speaker operates a low frequency driver but is adapted to have the same size as the three speakers above, operating as mid-range drivers. The low frequency driver is directed radially outwardly from the vertical line about which the pivot rods are co-axially aligned and is operated in the frequency range 20 to 800 Hz. The lowestmost speaker is driven by a separate amplifier housed within the speaker enclosure. A three way crossover network provides driving power to all speakers in the system excepting the low frequency driver, which is operated by the separate amplifier, whose input is powered by the three way crossover network. A pair of oppositely directed high-frequency drivers are secured to the baffle and are jointly driven in the frequency range of 8,000 to 20,000 Hz.

Since the lowermost grouping of speakers are of the same size and are judiciously phased to one another, acoustical phase problems are minimized. Furthermore, the high frequency drivers are judiciously phased to one another, thereby minimizing phase distortion problems. Finally, a separate amplifier may be incorporated to provide the extra driving power necessitated by the use of this quantity of speakers. Thus, there is produced a speaker apparatus whose distribution of sound, throughout the audible spectrum, is virtually omnidirectional, and whose minor lobes, existent therein, may be directed by rotating a baffle plate within an enclosure so as to shift the directionable lobes for all the speaker devices, thereby shifting the direction of all the frequency components within the audio spectrum.

Figure 1:
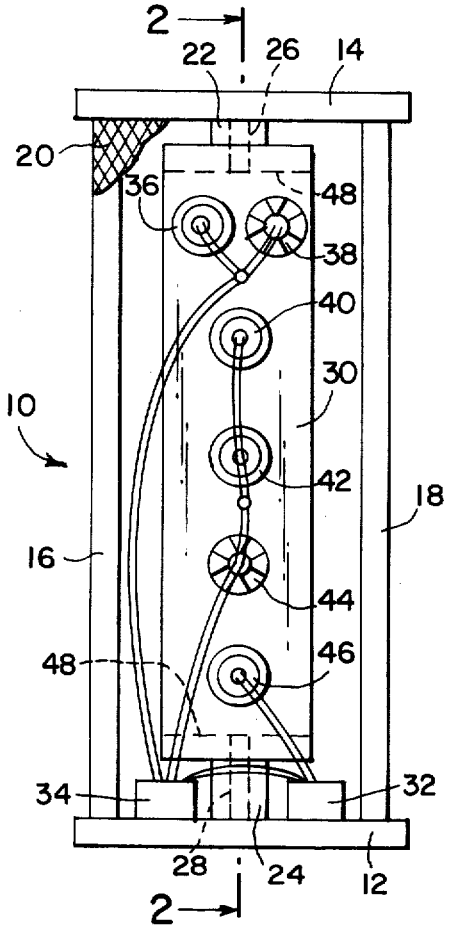
FIG. 1 is a front elevation view of the present invention.

Now referring to the Figures and more particularly to the embodiment illustrated in FIG. 1 showing enclosure 10 having a base portion 12 and a cap portion 14 disposed at the lowermost and uppermost regions thereof. Supports 16 and 18 inter-connect elements 12 and 14, and act as corner posts for the enclosure across which grille cloth 20 is stretched extending along the entire length thereof. Blocks 22 and 24 are secured to the lowermost innermost face of cap 14 and the uppermost innermost face of base element 12, respectively. Pivot rods 26 and 28, shown in dotted lines, extend outwardly from blocks 22 and 24 and are shown pivotably engaging a portion of baffle plate 30. Baffle plate 30 is thereofor free to rotate about pivot rods 26 and 28, which are co-axially aligned. Amplifier 32 and three way crossover network 34 are shown disposed within enclosure 10, mounted upon the uppermost innermost surface of base element 12. High frequency range drivers 36 and 38 are secured to baffle 30 and produce sounds directed in opposite directions. Speaker 36 emits sounds emanating forwardly from baffle 30 as shown. Speaker 38 emits sounds extending rearwardly from the front surface of baffle 30, as shown. Mid-range speakers 40, 42, and 44 are secured to baffle 30, having speakers 40 and 42 produce sounds principally emanating forwardly from baffle 30, as shown, whilst speaker 44 produces sounds directed principally towards the rear of baffle 30, as shown. Speaker 46, operating as a low frequency driver, driven by amplifier 32, produces sounds sensibly directed in equal magnitudes from the frontmost and rearmost surfaces of baffle 30.

Figure 2:
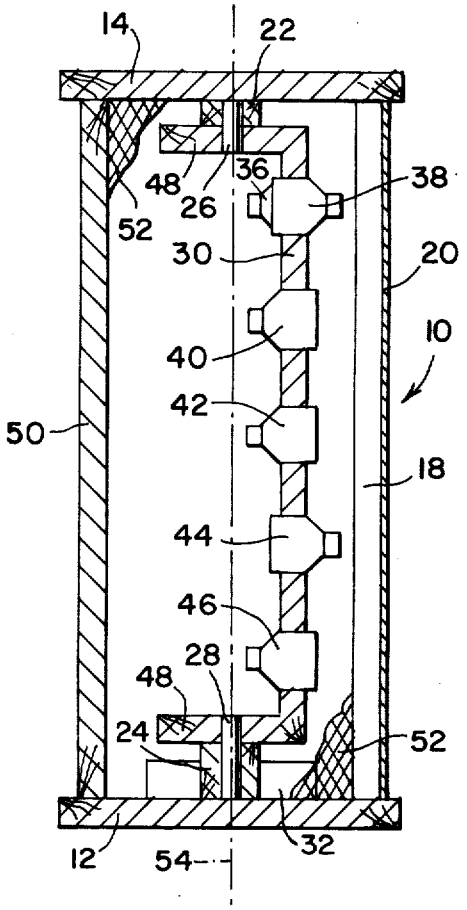
FIG. 2 is a side elevation, cross-sectional view of the present invention, taken through lines 2—2, as viewed in the direction of arrows 2—2, as shown in FIG. 1.

FIG. 2 illustrates baffle 30, having legs 48 affixed at ends thereof through which pivot rods 26 and 28 are pivotably engaged. Block 24 is shown to have a greater height than block 22 so as to allow amplifier 32 and the three way crossover network 34, shown in FIG. 1, to be mounted within enclosure 10. Support 50 serves to space apart base element 12 and cap element 14 and to provide a mounting surface for grille 52, stretching across the side of the enclosure. Speaker 38 is shown directed radially inwardly towards center line 54 about which pivot rods 26 and 28 are co-axially aligned. Speaker 36, as shown in FIG. 1, produces sound directed radially outwardly from center line 54. Both speakers 36 and 38 operate in the 8,000 to 20,000 Hz region, and are driven by one channel of the three way crossover network. Speakers 40, 42 and 46 are the same size. Speakers 40 and 42 produce sounds principally directed radially outwardly from center line 54, whilst speaker 44 produces sounds principally directed radially inwardly towards center line 54, all operating in the frequency range of 500 to 10,000 Hz being driven by another output channel of the three way crossover network. Speaker 46 is secured to baffle 30 so as to have its open mouth portion extending radially outwardly from the balance of the apparatus thereof. Speaker 46 is operated in the 20 to 800 Hz region and is driven by amplifier 32 which is in turn excited by the remaining output channel of the three way crossover network. Baffle 30 is free to rotate whilst residing in a vertical plane about center line 54 being spaced apart therefrom a fixed distance.

One of the advantages of the present invention is a speaker apparatus which is omnidirectional.

Another advantage of the present invention is a speaker baffle which may permit the more highly directed high frequency sound components to be angularly directed simultaneously with the less directional low frequency components of the audio frequency spectrum.

Still another advantage of the present invention is an omnidirectional speaker apparatus which utilizes three frequency bands and two sizes of speakers, thereby minimizing phase distortion.

Yet another advantage of the present invention is an omnidirectional speaker which may be positioned relative to the walls of a room thereby enhancing the esthetic appearance of the apparatus in conjunction with other furniture disposed within the room.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

I claim:

1. A speaker housing comprising a plurality of speakers, a mounting board carrying each of said speakers with the axes thereof in general parallel relationship, means for carrying said mounting board for pivotal movement about a vertical axis, said plurality of speakers each having an open mouth sound emitting portion and a sound generating portion, a first sub-plurality and a second sub-plurality of speakers comprising said plurality of speakers, said first sub-plurality of speakers having said open mouth portions thereof disposed on one face of said mounting board, said second sub-plurality of said plurality of speakers having said open mouth portions thereof disposed on the other face of said mounting board, said mounting board being located intermediate said sound generating portion of each of said first plurality of speakers and each of said sound generating portions of said second plurality of speakers whereby the sound emanating from said first plurality of speakers is oppositely directed from the sound eminating from said second plurality of speakers, an audio amplifier, a crossover network, said audio amplifier and said crossover network being disposed within said housing, said mounting board is generally planar and disposed generally vertically, wherein said first sub-plurality comprises a first speaker and a second speaker and a third speaker and a fourth speaker, said first speaker having a different size from said second speaker and said third speaker and said fourth speaker, said second speaker and said third speaker and said fourth speaker having the same size, said first speaker being operated substantially in the 8,000 to 20,000 Hz region, said second speaker and said third speaker being operated substantially in the 500 to 10,000 Hz region, said fourth speaker being operated substantially in the 20 to 800 Hz region, said second sub-plurality comprises a fifth speaker and a sixth speaker, said fifth speaker having the same size as said first speaker, said fifth speaker being operated in the same frequency range as said first speaker, said sixth speaker having the same size as said second speaker, said sixth speaker being operated substantially in the same frequency range as said second speaker, said fourth speaker being driven by said amplifier, wherein said crossover network comprises three outputs, a first output electrically driving said first and said fifth speakers, a second output electrically driving said second speaker and said third speaker and said sixth speaker, a third output electrically driving said amplifier.

2. The speaker housing as claimed in claim 1 wherein said enclosure comprises walls, said walls being substantially entirely acoustically transmissive, said walls being substantially entirely covered by a speaker grille cloth.

3. The speaker housing as claimed in claim 1 wherein said means includes a pivot rod engaging a generally planar horizontally disposed support member, said support member being fixed to said mounting board.

4. The speaker housing as claimed in claim 3 wherein said mounting board being disposed radially outwardly from said vertical axis, said pivot rod being disposed co-axially aligned with said vertical axis.

* * * * *